US005303010A

United States Patent [19]

Takano et al.

[11] Patent Number: 5,303,010

[45] Date of Patent: Apr. 12, 1994

[54] DOCTOR BLADE MOUNTING STRUCTURE

[75] Inventors: Masatoshi Takano; Satoru Morisawa, both of Tokyo, Japan

[73] Assignee: Asahi Kogaku Kogyo Kabushiki Kaisha, Tokyo, Japan

[21] Appl. No.: 895,033

[22] Filed: Jun. 8, 1992

[30] Foreign Application Priority Data

Jun. 7, 1991 [JP] Japan ..... 3-073726[U]

[51] Int. Cl.[5] ..... G03G 15/06; G03G 21/00

[52] U.S. Cl. ..... 355/245; 355/251; 355/299

[58] Field of Search ..... 355/245, 251, 253, 359, 355/299; 118/653, 657, 661

[56] References Cited

U.S. PATENT DOCUMENTS

| | | | |
|---|---|---|---|
| 3,927,936 | 12/1975 | Komori et al. | 355/299 |
| 4,297,026 | 10/1981 | Honda et al. | 355/299 |
| 4,325,628 | 4/1982 | Torigai et al. | 355/299 |
| 4,595,280 | 6/1986 | Tanzawa et al. | 355/299 |
| 5,081,504 | 1/1992 | Morisawa et al. | 355/299 |
| 5,091,748 | 2/1992 | Morisawa et al. | 355/245 |
| 5,128,716 | 7/1992 | Kita | 355/203 |
| 5,134,960 | 8/1992 | Shirai | 118/653 |
| 5,220,129 | 6/1993 | Nishio et al. | 355/251 X |

*Primary Examiner*—Fred J. Braun
*Attorney, Agent, or Firm*—Sandler, Greenblum & Bernstein

[57] ABSTRACT

A doctor blade mounting structure for mounting a doctor blade to a main body of a development device is provided, which includes a development roller which is rotatably arranged in the main body and on the outer circumferential surface of which a magnetic brush is formed. The doctor blade is disposed in confrontation with the development roller with a predetermined gap defined between the distal end of the doctor blade and the outer periphery of the development roller, for setting the height of the magnetic brush to a uniform level. The mounting structure is provided with a rigid support plate to which the doctor blade is attached, and fixing screws for fixing the rigid support plate to the main body of the development device are provided. The doctor blade is mounted to the main body of the development device through the support plate. A doctor blade adjusting member for adjusting the predetermined gap of the doctor blade includes a screw which has its head portion engage the rear portion of the doctor blade to move the doctor blade in a plane toward and away from the development roller.

3 Claims, 5 Drawing Sheets

DOCTOR BLADE MOUNTING STRUCTURE

BACKGROUND OF THE INVENTION

The present invention relates to a doctor blade mounting structure for mounting a doctor blade to a development unit of an imaging apparatus using of electrophotography.

In a known imaging apparatus such as an electrophotographic copy machine, laser beam printer and the like using electrophotography, an electrostatic latent image is formed by exposing the surface of a photoconductive drum formed of a photoconductive material, toner is adhered onto the latent image and developed, and then the toner is transferred onto a recording paper and fixed by a fixing unit.

Although various systems are contemplated as development methods in electrophotography, a system referred to as a magnetic brush method is widely used, wherein charged toner is supplied to an electrostatic latent image by a magnetic material carrier (magnetic brush) arranged in a chain shape by a magnet.

Although the magnetic brush method employs a two-component developer composed of non-magnetic toner mixed with a magnetic material carrier at a preset ratio, recently a so-called 1.5 component development is employed, wherein one-component charged type magnetic toner is used and a magnetic material carrier is predeposited onto a development roller.

A development unit to which the magnetic brush method is applied includes a development roller formed by rotatably installing a sleeve of a non-magnetic material around the periphery of a magnetic roller with toner sequentially supplied to a development area by rotating the sleeve of the development roller.

To develop a good image, the magnetic brush must be disposed on a uniform level with pinpoint accuracy. Thus, a flat-plate-shaped doctor blade is provided in confrontation with the outside periphery of the development roller (the outside periphery of the sleeve) and a predetermined gap (doctor gap) is set between the extreme end of the doctor blade and the outside periphery of the development roller to thereby regulate the height of the magnetic brush.

The doctor blade is adjusted in such a manner that a gage having a thickness similar to a doctor gap to be set is held between the outside periphery of the development roller and the extreme end of the doctor blade to thereby evenly press and fix the doctor blade.

Nevertheless, a problem arises in that it is very difficult to fix the flat-plate-shaped doctor blade extending over the entire longitudinal length of the development roller with respect to the development roller with a doctor gap evenly adjusted over the entire longitudinal extent of the development roller. More specifically, since the flat-plate-shaped slender doctor blade is originally very deformable by itself, it is very difficult to obtain a machining accuracy such as a straight line accuracy and suppress the occurrence of a twisted portion and the like, thus the cross section of the doctor blade must be increased by making the blade thicker to prevent the deformation thereof by providing it with rigidity. However, but the increase in the cross section of the doctor blade increases the size of the development unit. Accordingly, the size of an imaging apparatus increase using the development unit as a whole. Thus, the increase of the cross section of the doctor blade is not preferable. As a result, a deformable doctor blade must be abutted against a gage horizontally abutted against or fixed to the outside periphery of the development roller over the entire length thereof by applying an even pressing force and fixed thereto by a plurality of clamping screws. Thus, an adjusting job is time consuming and the doctor blade is difficult to be set and adjusted with pin-point accuracy.

SUMMARY OF THE INVENTION

It is therefore an object of the present invention to provide a doctor blade mounting structure for a development unit capable of preventing the deformation of a doctor blade and a doctor gap adjusting structure for the development unit for easily and precisely adjusting the doctor blade.

To achieve the above object, a doctor blade mounting structure according to one aspect of the present invention is provided for mounting a doctor blade to main body of a development device which includes a development roller which is rotatably arranged in the main body and on the outer circumferential surface of which a magnetic brush is formed. The doctor blade is disposed in confrontation with the development roller with a predetermined gap defined between the distal end of the doctor blade and the outer periphery of the development roller, for setting the height of the magnetic brush to a uniform level. The mounting structure includes a rigid support plate to which the doctor blade is attached, and a fixing device for fixing the rigid support plate to the main body of the development device, whereby the doctor blade is mounted to the main body of the development device through the support plate.

With this arrangement, since the doctor blade is mounted to a main body through the rigid support plate, the doctor blade need not be rigidly formed. Alternatively, the doctor blade can be made to have a thin thickness, and since the straight line accuracy thereof depends upon the support plate, it can be easily machined, which contributes to a cost reduction.

Further, another aspect of the doctor blade mounting structure, according to the present invention, comprises a doctor gap adjusting mechanism provided between the doctor blade and the rigid support plate, for adjusting said doctor gap by the doctor blade being approached to and retracted from the development roller.

With this arrangement, a fine adjustment of the doctor blade can be very easily carried out, whereby the workability of an adjustment job is improved and working efficiency is greatly improved.

The above, and other objects, features and advantages of the present invention will become apparent from the following detailed description which is to be read in conjunction with the accompanying drawings.

DETAILED DESCRIPTION OF PREFERRED EMBODIMENT

One embodiment of a doctor blade mounting structure according to the present invention will be described below with reference to the attached drawings.

Figure 1:
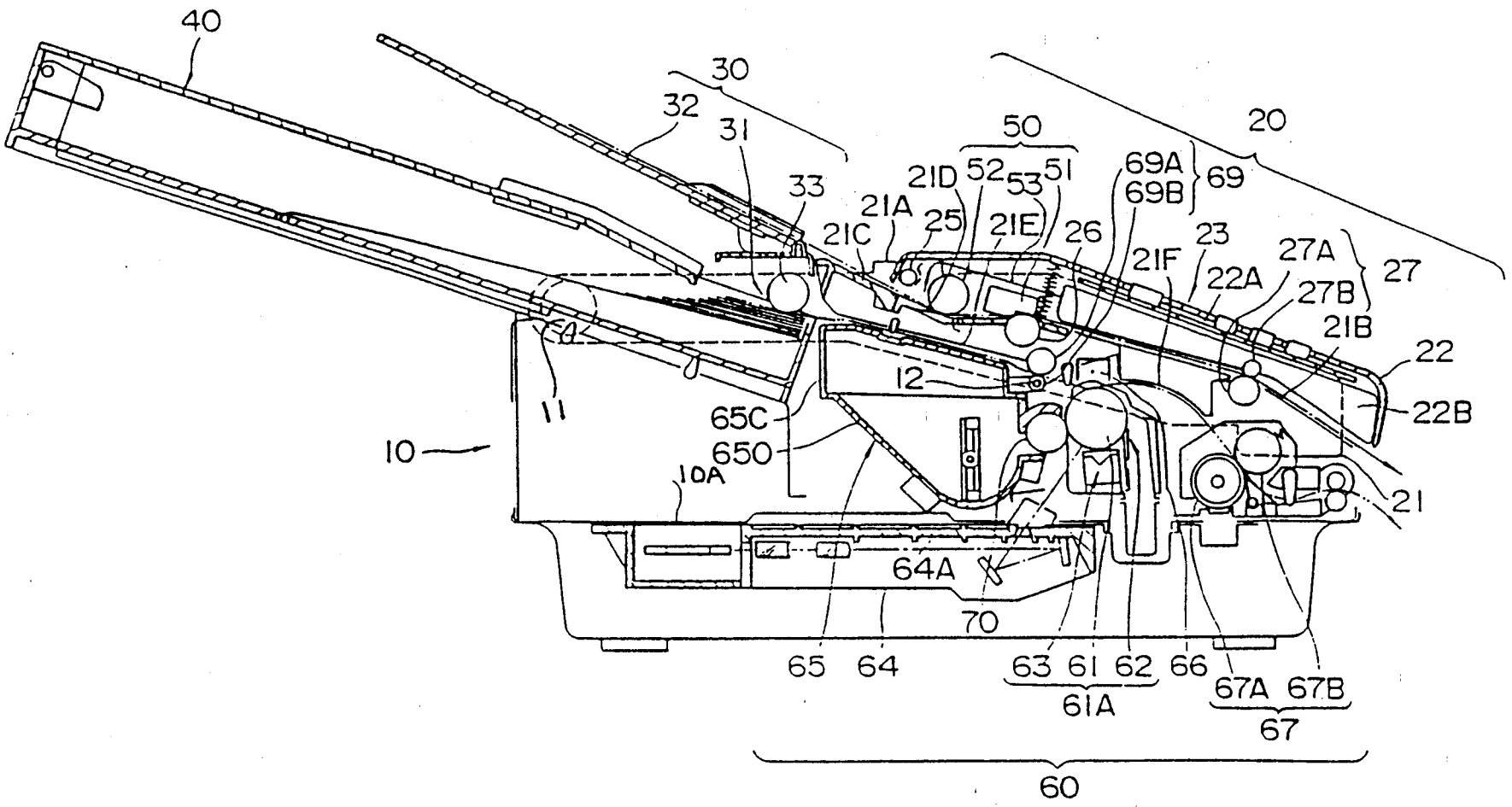
FIG. 1 is a schematic longitudinal cross sectional view of an electrophotographic facsimile apparatus provided with a development unit to which one embodiment of a doctor blade mounting structure according to the present invention is applied.

FIG. 1 is a schematic longitudinal cross sectional view of an electrophotographic facsimile apparatus provided with a development unit to which an embodiment of a doctor blade mounting structure according to the present invention is applied, wherein the right side corresponds to the front side of the apparatus.

As shown in FIG. 1, the facsimile apparatus comprises a main body 10 and an upper component 20 as a member covering the front upper portion of the main body 10. A paper feed unit 30 is disposed on the upper rear portion of the main body 10 for feeding or introducing recording papers on which received information is to be recorded and documents from which information by transmitted is read to the apparatus.

The upper surface of the upper component 20 gradually inclines downward toward the front end of the apparatus, and an operation unit 23, including a display panel, operation buttons and the like, is disposed thereon.

A reading head 50 is contained in the upper component 20. A document to be transmitted is fed from the paper feed unit 30 through the upper component 20, and the information recorded on the document is read by the reading head 50.

A recording unit 60, provided with various operation mechanisms for electrophotography, is accommodated in the main body 10. The recording papers, to which received information is to be output, are fed from the paper feed unit 30, between the main body 10 and the upper component 20, to the recording unit 60 where the received information is recorded onto the recording paper by the recording unit 60.

The respective units will be sequentially described in detail below.

The paper feed unit 30 is composed of a cassette mounting unit 31 having a recording paper cassette 40 detachably mounted to the recording paper introduction position of the paper feed unit 30 and a document holder 32 for documents to be transmitted located at the front edge (right side in FIG. 1) of the cassette mounting unit 31. The cassette 40 contains recording papers onto which received information is recorded.

The cassette mounting unit 31 has a recording paper introduction roller 33 disposed at the position corresponding to the upper extreme end of the recording papers contained in the recording paper cassette 40 mounted to the cassette mounting unit 31. The recording paper introduction roller 33 is rotated by a drive motor (not shown).

The upper component 20 is composed of an arm 21A, which extends from a panel frame 21 serving as the framework of the upper composition 20, toward the rear end of the apparatus and is swingably supported by a swing shaft 11, located at the upper rear portion of the main body 10, and an operation panel 22, which constitutes the upper surface of the upper component 20 and is swingably supported by a pin 25 at the end of the upper component 20 on the paper feed unit 30 side. Thus, in this arrangement, the upper composition 20 can be swingingly opened and closed together with the operation panel 22. The operation panel 22 can be swingingly opened and closed independently of the upper component 20.

An operation panel base plate 22A is attached to the operation panel 22 along the inside (lower side) thereof, an upper document guide plate 22B is disposed inwardly of the operation panel base plate 22A (the main body 10 side). The reading head 50 is disposed in close proximity to the document introduction side of the upper document guide plate 22B (the paper feed unit 30 side).

The reading head 50 is composed of a close contact type reading sensor 51 and a document introduction roller 52 each supported by a head frame 53. The operation panel 22 is swingably supported by the pin 25 by which the panel frame 21 is also supported, with the document introduction roller 52 located at the paper feed unit 30 side.

The panel frame 21 has a lower document guide plate 21B located at the position corresponding to the upper document guide plate 22B, a feed roller 26 located at the position corresponding to the reading sensor 51 of the reading head 50, and a lower introduction unit guide 21C located at the position corresponding to the reading head 50, respectively.

The rear end (the side adjacent to the paper feed unit 30) of the lower introduction unit guide 21C is formed as an inclined surface contiguous to the document holder 32 of the paper feed unit 30. A press and support plate 21D is disposed at the position corresponding to the document introduction roller 52 and the lower introduction unit guide 21C, in the state that the press and support plate 21D is pressed and urged against the document introduction roller 52 from the lower side thereof by an elastic return force.

Further, a pair of paper discharge rollers 27 are disposed substantially midway along the longitudinal direction of the lower document guide plate 21B is composed of a lower roller 27A, slightly projecting above the upper surface of the lower document guide plate 21B, and an upper roller 27B abutted against the projected upper surface of the lower roller 27A.

With the arrangement of the operation panel 22 and panel frame 21, a document path is formed between the document guide member on the operation panel 22 side (the reading sensor 51 and upper document guide plate 22B) and the document guide member on the panel frame 21 side (the lower introduction unit guide 21C, press and support plate 21D and lower document guide plate 21B). The document introduction roller 52 of the reading head 50, the feed roller 26 of the panel frame 21 and the lower roller 27B of the pair of paper discharge rollers 27 are driven by a drive drive motor (not shown) at a predetermined circumferential speed to feed a document placed on the document holder 32 through the document path along a feed path shown by a dot-dash-line in FIG. 1. Information to be recorded on the document is recorded by being read by the reading head 50. More specifically, the docment placed on the document holder 32 is introduced into the upper component 20 by the document introduction roller 52 and the information recorded on the upper surface of the document is read by the reading sensor 51 while the document is being fed by the feed roller 26. Then, the document is fed by the pair of discharge rollers 27 and discharged through the front end of the main body 10. Note, as described above, the reading head 50 is disposed above the document feed path in this arrangement. A document is placed on the document holder 32 with the information recorded surface thereof (the surface from which information is to be read) faced upward. Thus, the document is fed, the information is read and the document is discharged, in this state.

On the other hand, the main body 10 includes the recording unit 60 provided with the various operation mechanisms for electrophotography, as described above.

More specifically, there are disposed, around the photoconductive drum a cleaning mechanism 62 for cleaning toner remaining on the surface of a photoconductive material, a corona charger 63 for uniformly charging the photoconductive material on the surface of the photoconductive drum 61, and a scanning optical unit 64 for exposing and scanning the charged surface of the photoconductive drum 61 with a laser beam which is turned ON and OFF based on image information. Further disposed around the photoconductive drum are, a development unit 65 for forming a toner image by adhering toner to the portion of the photoconductive material where a latent image is formed by the removal of electric charge therefrom by exposure, and a transfer charger 66 for transferring the toner image onto a recording paper by charging the recording paper. The photoconductive drum 61 is driven at a predetermined circumferential speed by a drive motor (not shown). A fixing unit 67 is disposed at a position toward which the recording paper on which the toner image is transferred by the transfer charger 66 is fed.

The cleaning mechanism 62 includes a blade formed of an elastic member, abutted against the surface of the photoconductive drum 61 arranged as a photoconductive drum unit 61A by being mounted on a single frame together with the photoconductive drum 61 and corona charger 63.

The development unit 65 is composed of a main body housing 650 and a development roller 70, the former including a toner cartridge 65C detachably mounted thereon and the latter having a cylindrical sleeve into which a magnet roller is inserted and rotatably supported on one side in the front and rear direction thereof the main body housing 650. The main body housing 650 has a support shaft 12 which is parallel with the development roller 70 and located at the upper portion of the vessel 65A corresponding to the right side of the toner cartridge 65C, as shown in FIG. 1. The development unit 65 is supported by the chassis of the main body 10 (not shown) and swung about the support shaft 12 with the development roller 65B in close proximity to the photoconductive drum 61 on the rear side thereof with respect to the apparatus in such a manner that the opposite ends of the support shaft 12 are engaged with U-shaped grooves which are formed to the chassis and open upward.

The scanning optical unit 64 is composed of the respective components of the scanning optical system for scanning the surface of the photoconductive drum 61 with a laser beam which is turned ON and OFF based on image information and these components are integrally arranged by being mounted on a unit frame 64A. Further, the scanning optical unit 64 is mounted on the lower surface of a main body chassis 10A below the development unit 65 and paper feed unit 30 and a laser beam from the scanning optical unit 64 passes between the corona charger 63 and the development unit 65 and is projected onto to the photoconductive drum 61 (for scanning the photoconductive drum 61).

The transfer charger 66 is supported above the photoconductive drum 61 by the panel frame 21 of the upper component 21.

The fixing unit 67 is composed of a heat roller 67A, heated to a predetermined temperature, and a press roller 67B located obliquely upward of the heat roller 67A on the front end side of the apparatus, pressed against the heat roller 67A, and fixed on the upper surface at a predetermined position of the main body chassis 10A. The heat roller 67A is rotated at a circumferential speed in synchronism with that of the photoconductive drum 61. Thus the fixing unit necessarily feeds a recording paper in addition to carrying out a fixing action.

Further, the inclined upper surface of the toner cartridge 65C of the development unit 65 is disposed in close proximity to the upper recording paper guide plate 21E disposed on the lower side of the lower introduction unit guide 21C of the panel frame 21 of the upper component 20 with a predetermined space defined therebetween. A recording paper feed path regulation plate 21F, disposed on the lower surface of the lower document guide plate 21B of the panel frame 21, is located above the photoconductive drum 61 and the fixing unit 67 and therebetween and is formed with an arc shape directed from the transfer unit 66 toward the fixing unit 67 located obliquely downward of the transfer charger 66 on the front end side of the apparatus.

Furthermore, a pair of rollers 69 are composed of a roller 69B, into which the support shaft 12 of the development unit 65 is inserted, and a feed roller 69A disposed on the upper composition 20 side with respect to the roller 69B. The feed roller 69A is rotated by a drive motor (not shown) at the same circumferential speed as that of the photoconductive drum 61.

With the aforesaid arrangement of the recording unit 60 and upper component 20, a recording paper feed path is formed between the recording paper guide member on the upper surface of the recording unit 60 (the upper surface of the toner cartridge 65C) and the recording paper guide member on the lower surface of the upper component 20 (the upper recording paper guide plate 21E and recording paper feed path regulation plate 21F). Recording papers, accommodated in the recording paper cassette 40 mounted to the cassette mounting unit 31 of the paper feed unit 30, are fed through the recording paper path along a feed path shown by a two-dot-dash-line in FIG. 1. Received information is printed on the lower surface of each of the recording papers by the recording unit 60. More specifically, the recording papers accommodated in the recording paper cassette 40 are sequentially introduced into the recording paper path from the uppermost one thereof by the rotation of the recording paper introduction roller 33 of the cassette mounting unit 31. The charged surface of the photoconductive drum 61 is main-scanned (exposed) in the rotational axis direction thereof with a laser beam modulated by received characters or image information and emitted from the scanning optical unit 64 and at the same time the photoconductive drum 61 is sub-scanned (rotated). Thus the development unit 65 develops a latent image formed on the surface of the photoconductive drum 61 and forms a toner image, the toner image is transferred onto the recording paper, fed by the pair of drive rollers 69 at a speed in synchronism with the circumferential speed of the photoconductive drum 61, and charged by the transfer charger 66. Further, the toner image is fixed onto the recording paper by the fixing unit 67 and then the recording paper is discharged through the front end of the apparatus.

Next, the development unit 65, to which a doctor blade 90 is mounted, will be described in more detail with reference to an embodiment of a doctor blade mounting structure and doctor gap adjusting structure for the development unit, according to the present invention.

Figure 2:
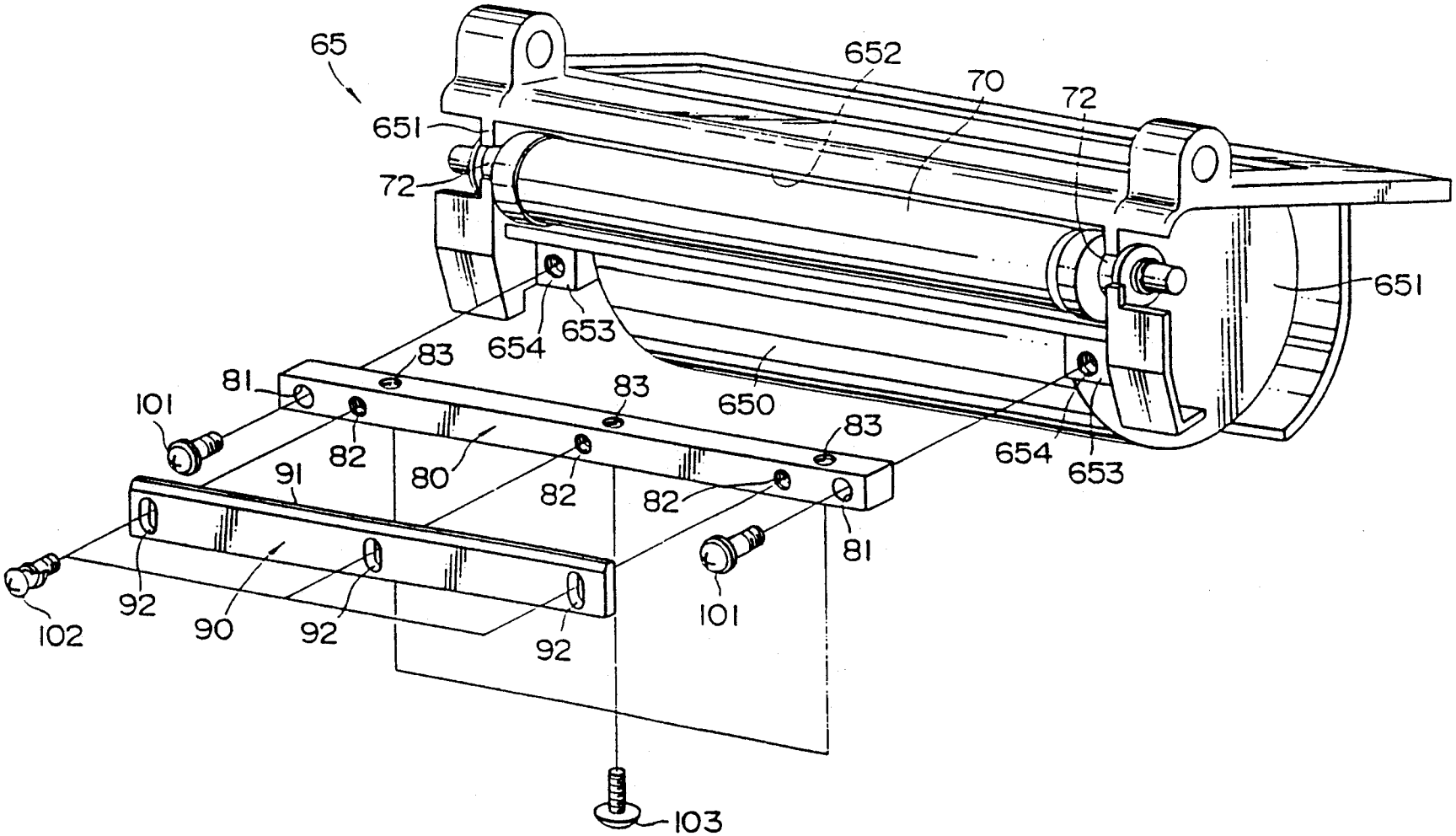
FIG. 2 is an exploded perspective view of the development unit.

FIG. 2 is an exploded perspective view showing the mounting structure of the doctor blade 90 for the development unit 65. Note that the toner cartridge 65C, as described above in connection with FIG. 1, is removed in FIG. 2.

The development unit, as shown in FIG. 2, is arranged such that the development roller 70 is rotatably supported at the opposite ends thereof by the right and left side walls 651, 651 of the main body housing 650 through bearings 72. The periphery of the development roller 70 is exposed in a predetermined range through an opening 652 defined in the longitudinal direction of the housing 650 and stored toner is supplied through this exposed portion to the surface of the photoconductive drum, which is not shown in FIG. 2.

Support plate mounting bases 653 each defined with a clamping screw hole 654 are formed, respectively to the housing 650 at the portion thereof adjacent to the side walls 651, 651 below the opening 652 and a support plate 80 is mounted to the support plate mounting bases 653 by screws 101 at the opposite ends thereof. Further, the doctor blade 90 is fixed to the support plate 80 by a plurality of screws 102. The support plate 80 is made of rigid material, for example, a metal, more specifically, stainless steel.

The support plate 80 has a cross section of a predetermined width and height and a length covering both support plate mounting bases 653 (i.e., a length than the developing area of the development roller 70) as well as having a high rigidity so that it cannot be easily deformed. Attachment holes 81 are defined at the opposite ends of the support plate 80 in the thickness direction thereof and a plurality of blade mounting screw holes 82 are defined between these attachment holes 81, in the thickness direction thereof, at predetermined intervals. Further, blade adjusting screw holes 83 are vertically defined through the support plate 80 in the vicinity of the blade mounting screw holes 82 (in the direction perpendicular to the blade mounting screw holes 82). As shown in the partial cross sectional view of this portion in FIG. 3, the support plate 80 is mounted to the housing 650 by the screws 101 passing through the attachment holes 81 and threadedly engaged with the clamping screw holes 654 of the support plate mounting bases 653. The plane on the level of the outside surface of the support plate 80 mounted to the housing 650 (the surface opposite the surface against which the support plate mounting bases 653, 653 are abutted) passes through the center of rotation of the development roller 70. Further, blade adjusting screws 103 serving as a blade adjusting member, are threaded into the blade adjusting screw holes 83 from the rear end side (lower end side) of the support plate 80.

The doctor blade 90 and is formed as a thin plate shape with an upper edge 91 of an acute angle defined along the upper side thereof. Mounting slots 92 are vertically defined through the doctor blade 90 at the positions corresponding to the blade mounting screw holes 82 of the support plate 80, respectively. The doctor blade 90 is fixed to the support plate 80 by the clamping screws 102 passing through the mounting slots 92 and threadedly engaged with the blade mounting screw holes 82.

Figure 4:
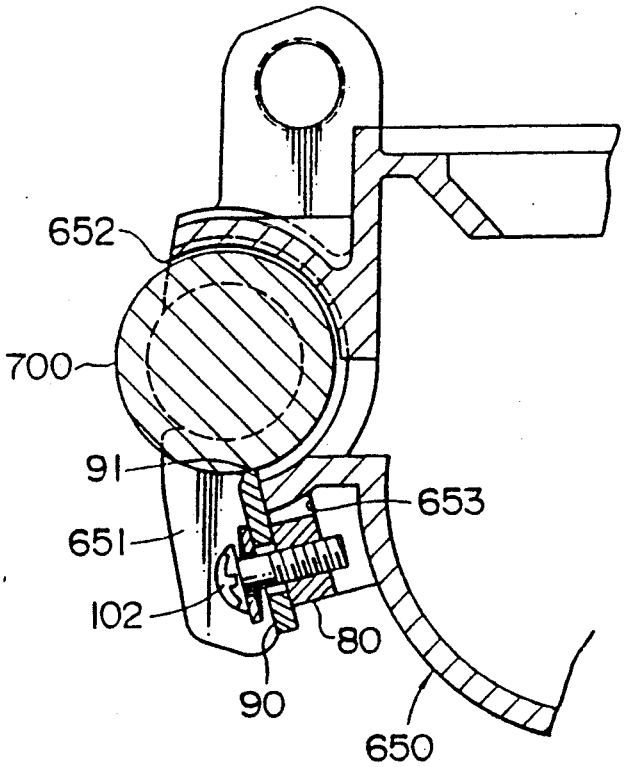
FIG. 4 is a cross sectional view of a screw for fixing a doctor blade to the support plate at the central portion thereof.

As shown in the cross sectional view of the central portion of the clamping screw 102 in FIG. 4, when the doctor blade 90 is normally mounted to the support plate 80 with a predetermined gap defined between the outside periphery of the development roller 70 and the doctor blade 90, the rear end edge (lower end edge) thereof projects downward from the rear edge surface (lower edge surface) of the support plate 80. Further, as shown in the cross sectional view of the central portion of the blade adjusting screw 103 in FIG. 5, the flange portion of the screw head of the blade adjusting screws 103 is abutted against the projected rear end surface of the doctor blade 90. More specifically, the doctor blade 90 and each of the blade adjusting screws 103, threadedly engaged with each of the blade adjusting screw holes 83 have such a positional relationship that the moving range of the screw head of the blade adjusting screw 103, subject to adjustment by being threaded with the blade adjusting screw hole 83, interferes with the doctor blade 90.

Figure 3:
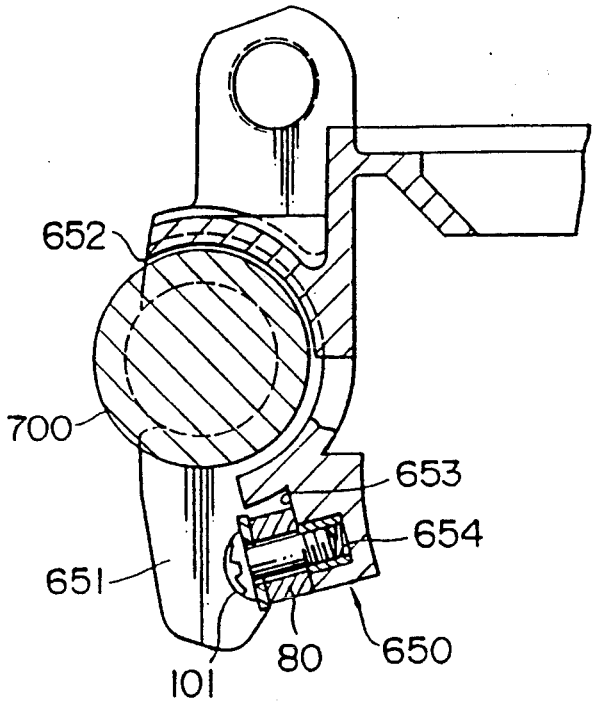
FIG. 3 is a cross sectional view of a screw for fixing a support plate to a main body at the central portion thereof.
Figure 5:
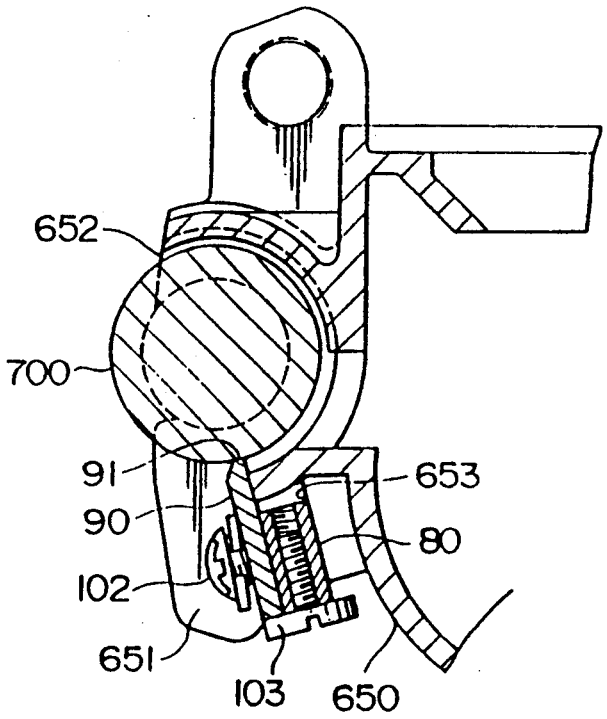
FIG. 5 is a cross sectional view of a blade adjusting screw at the central portion thereof.

Note that FIGS. 3 through 5 show a state wherein a dummy roller 700, having a radius obtained by adding a desired doctor gap to the radius of the development roller 70, is mounted in place of the development roller 70. The dummy roller 700 will be described later in detail. Consequently, when the doctor blade 90 is properly mounted, the edge 91 thereof is abutted against the outside periphery of the dummy roller 700.

With the above arrangement, the doctor blade 90 is tentatively mounted to the support plate 80 by the clamping screws 102 in the state that it can move in the range of the mounting slot 92 and cannot drop. The screw head of the blade adjusting screws 103, threaded into the blade adjusting screw holes 83 of the support plate 80 from the rear end surface thereof, is abutted against the rear end of the doctor blade 90. A threaded amount of the blade adjusting screws 103 is adjusted such that the doctor blade 90 is supported by the blade adjusting screws 103. As a result, the doctor blade 90 can be moved for adjustment and thus a doctor gap can be very easily and precisely adjusted. Note that the doctor blade 90 may be mounted to the housing 650 by a method of tentatively mounting the doctor blade 90 to the support plate 80 by the clamping screws 102. Then, mounting the support plate 80 is mounted to the housing 650 by the screws 101, or a method of mounting the support plate 80 to the housing 650 by the screws 101, and then mounting the doctor blade 90 to the support plate 80 by the clamping screws 102. Any one of these methods can be selected by taking workability into consideration.

Figure 6:
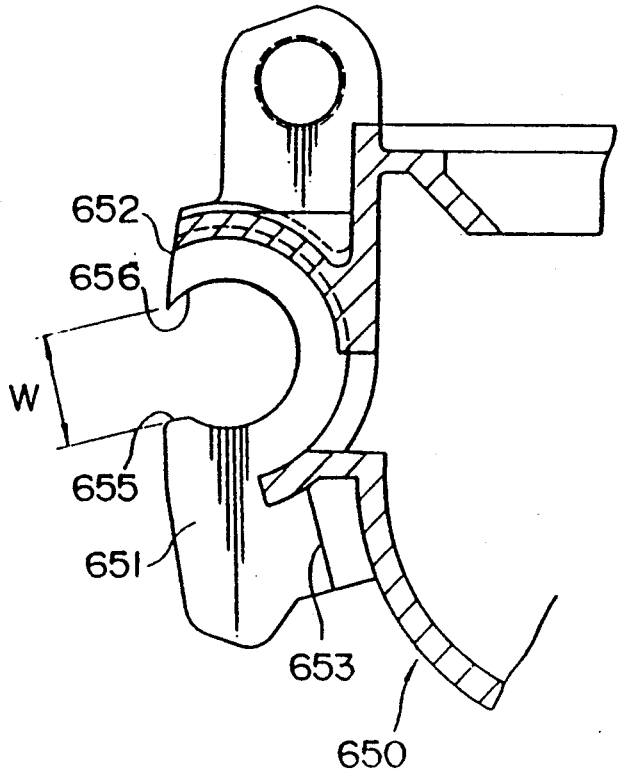
FIG. 6 is a diagram showing a side plate from which a development roller is removed.

On the other hand, as shown in FIG. 6 which illustrates the state that the photoconductive drum 70 is removed, mounting holes 656, with which the bearings 72 are engaged, are defined to the side walls 651, 651 of the housing 650 by which the development roller 70 is supported. Thus, the development roller 70 is rotatably supported by the housing 650 through the bearings 72 engaged with the mounting holes 656.

The mounting hole 656 is opened forward through a slit having a predetermined width W which is smaller than the diameter of the bearing 72 and larger than the shaft 701 of the dummy roller 700, thus the dummy roller 700, having a radius obtained by adding a desired doctor gap to the radius of the development roller 70 can be mounted to the mounting holes 656 through the slit 655 in the same way as the development roller 70.

Figure 7:
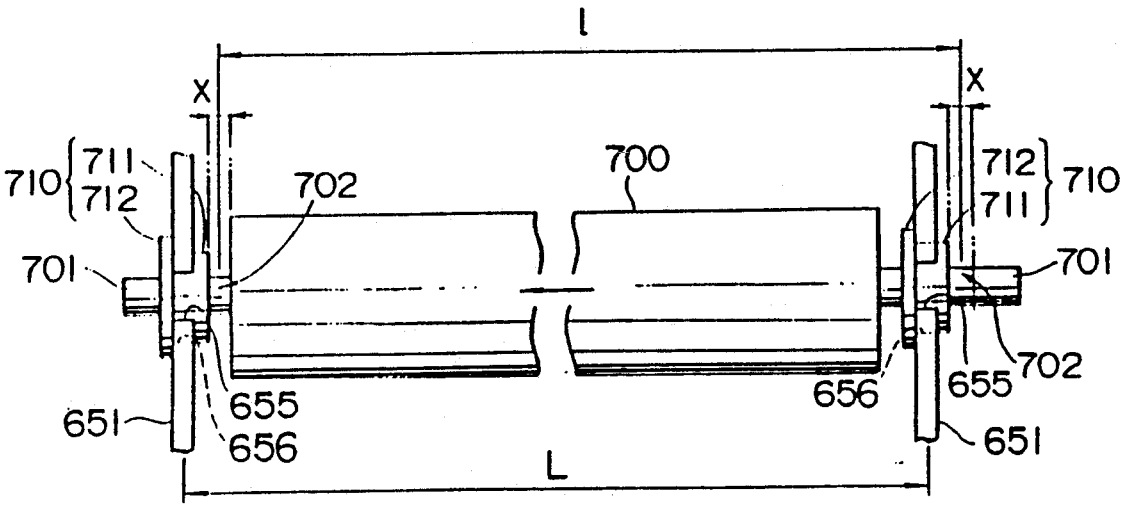
FIG. 7 is a front view showing the mounting state of a dummy roller.

More specifically, as shown in the front view of the dummy roller 700 mounted to the housing 650 (side plates 651), the dummy roller 700 has shafts 701 projecting from the opposite ends thereof and having a diameter smaller than the width W of the slit 655. The bearings 710 are mounted to the shafts 701, each of the bearings 710 having a collar 712 formed on one side of a bearing main body 711 and having a diameter larger than that of the bearing main body 711. In FIG. 7, each of the bearings 710 is mounted with the collar 712 located on the left side thereof.

Further, a portion 702 of each of the shafts, 701 is exposed in a width X on the side opposite to the collar 712 of the bearing 710. The width X is larger than the thickness of the side wall 651 and the interval l between the exposed portions 702 on the opposite sides of the shafts 701 is set to have the same distance with that of the interval L between the side walls 651.

With the above arrangement, the dummy roller 700 can be easily mounted in such a manner that after the shafts 701 have been positioned in the mounting holes 656 with the exposed portions 702 corresponding to the slits 655 of the side walls 651, the bearing main bodies 711 are engaged with the mounting holes 656 by causing the bearings 710 to approach to the side walls 651 and further the dummy roller 700 can be easily removed by reversing the above procedure (by moving the dummy roller 700 in the direction shown by the arrow in FIG. 7).

Thus, the doctor blade 90 can be mounted in the state that a doctor gap is adjusted in such a manner that the dummy roller 700 is mounted to the mounting holes 656, the doctor blade 90 is evenly abutted against the outside periphery of the dummy roller 700 in the longitudinal direction thereof by the aforesaid adjustment method. Then, the clamping screws 102 are tightened to fix the doctor blade 90 to the support plate 80. More specifically, the adjustment of the doctor blade 90 is completed by such a simple job that the blade adjusting screws 103 are threadingly adjusted to push the doctor blade 90 upward by the screw heads thereof until the edge 91, of the doctor blade 90, is evenly abutted against the entire outside periphery of the dummy roller 700. The doctor blade 90 is fixed to the support plate 80 by tightening the clamping screws 102. Note that the blade adjusting screws 103 are preferably removed after the completion of the adjustment.

Figure 8:
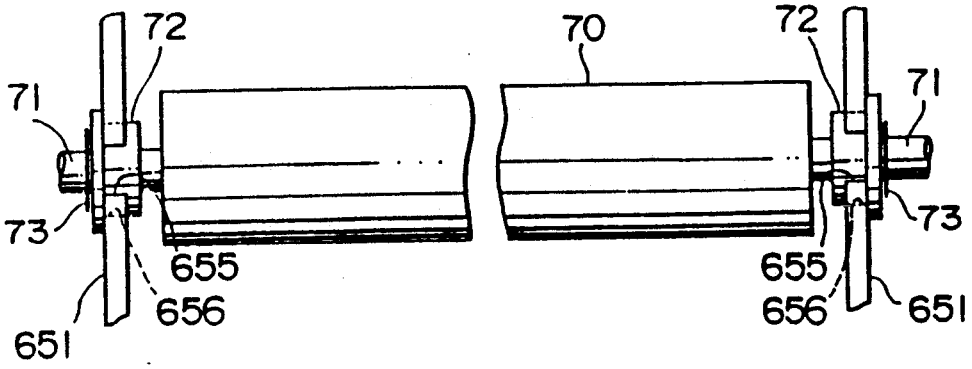
FIG. 8 is a front view showing the mounting state of a development roller.

After the doctor gap has been adjusted, the dummy roller 700 is removed from the housing 650 and the development roller 70 is mounted to the side plates 651. For example, as shown in FIG. 8, the shaft 71 is positioned in the mounting holes 656 through the slits 655 in the state that the bearings 72 are not mounted. Each of the bearings 72 is engaged with the shaft 71 and mounting hole 656 from the outside of the side plate 651. Then, a bearing slipping-out prevention member 73, such as an E-ring or the like, is attached to the shaft 71 outwardly of the bearing 72 in close proximity thereto, so that the bearing 72 can be mounted in the state that it does not drop. In this state, a predetermined doctor gap is established between the outside periphery of the development roller 70 and the edge 91 of the doctor blade 90.

Note, although the scraper structure for the development unit, according to the present invention, is applied to the development unit for the electrophotographic facsimile apparatus in the aforesaid embodiment, the present invention is not limited thereto and the scraper structure may be applied to a development unit for a copy machine and the like.

The present disclosure relates to subject matters contained in Japanese Utility Model Application No. HEI 3-73726 filed on Jun. 7, 1991, which is expressly incorporated herein by reference in its entirety.

What is claimed is:

1. A doctor blade mounting structure for mounting a doctor blade to a main body of a development device which includes a development roller which is rotatably arranged in said main body, and on an outer circumferential surface of which, a magnetic brush is formed, said doctor blade being disposed in confrontation with said development roller with a predetermined doctor gap defined between a distal end of said doctor blade and an outer periphery of said development roller, for setting a height of said magnetic brush to a uniform level, said doctor blade mounting structure comprising:

a rigid support member to which said doctor blade is attached;

fixing means for fixing said rigid support member to said main body of said development device;

doctor gap adjusting means provided between said doctor blade and said rigid support member and adjusting the relationship between said doctor blade and said rigid support member, for adjusting said doctor gap by said doctor blade extending towards and retracting from said development roller;

whereby said doctor blade is mounted to said main body of said development device through said support member;

said doctor gap adjusting means including a doctor blade adjusting member provided to said rigid support member, to be movable in a direction intersecting the outer periphery of the development roller, for allowing an amount of said doctor gap to be adjusted by moving said adjusting member, said doctor blade disposed in a plane including a central axis of rotation of said development roller and movable along said plane;

said doctor blade adjusting member comprising a screw threaded into an under end surface of said support member;

said doctor blade being disposed below said development roller;

said doctor blade comprising a lower end which projects downward from a lower end of said support member, and said screw is disposed at a position such that a head portion of said screw interferes with a lower rear portion of said doctor blade.

2. The doctor blade mounting structure according to claim 1, wherein said rigid support member is made of a metal.

3. The doctor blade mounting structure according to claim 2, wherein said rigid support member is made of stainless steel.

* * * * *